US008740128B2

(12) United States Patent
Oravits et al.

(10) Patent No.: US 8,740,128 B2
(45) Date of Patent: Jun. 3, 2014

(54) WINDER ASSEMBLY AND METHOD OF USE THEREOF

(75) Inventors: Thomas J. Oravits, Durham, CT (US); John Radovich, Mystic, CT (US); Edward J. Smith, Frenchtown, NJ (US)

(73) Assignee: Davis-Standard, LLC, Pawcatuck, CT (US)

( * ) Notice: Subject to any disclaimer, the term of this patent is extended or adjusted under 35 U.S.C. 154(b) by 211 days.

(21) Appl. No.: 13/364,644

(22) Filed: Feb. 2, 2012

(65) Prior Publication Data

US 2013/0200200 A1 Aug. 8, 2013

(51) Int. Cl.
*B65H 19/22* (2006.01)

(52) U.S. Cl.
USPC ..... 242/533.4; 242/527.2; 242/533.5

(58) Field of Classification Search
USPC ..... 242/526, 527.2–527.3, 533.4–533.5
See application file for complete search history.

(56) References Cited

U.S. PATENT DOCUMENTS 3,377,032 A 4/1968 Jacobs et al.
3,478,975 A 11/1969 Penrod
3,871,595 A * 3/1975 Smolderen ..... 242/527.4
4,326,679 A * 4/1982 Phelps et al. ..... 242/526
4,484,714 A * 11/1984 Puzey ..... 242/527.3
5,417,382 A * 5/1995 Petitjean et al. ..... 242/527
5,845,867 A * 12/1998 Hould et al. ..... 242/527

OTHER PUBLICATIONS

International Search Report for corresponding PCT Application No. PCT/US2013/024376 dated May 27, 2013.

* cited by examiner

*Primary Examiner* — Sang Kim
(74) *Attorney, Agent, or Firm* — MKG, LLC

(57) ABSTRACT

In a winder assembly, a turret assembly indexes first and second cores between winding and removal positions. A lay-on roll assembly includes a roller and moves between a retracted position and an engaged position wherein the roller and the core, or the work material wound onto the core, cooperate to form a nip. A cutter is provided for cutting a web of sheet-type work material being wound onto the core. An enveloper assembly is provided and includes a nipping pivot roller that can engage a cut edge of the work material and feed the cut edge into the nip formed between the roller forming part of the lay-on roll assembly and a fresh core thereby allowing the work material to wind around the core.

5 Claims, 7 Drawing Sheets

WINDER ASSEMBLY AND METHOD OF USE THEREOF

FIELD OF THE INVENTION

The present invention is generally directed to apparatus and methods for changing cores upon which a web of sheet-type work material is wound and is more particularly directed to apparatus and methods for automatically changing a core and causing the web of sheet-type work material to be wound there around.

BACKGROUND OF THE INVENTION

Subsequent to formation, polymeric films and or sheets of polymeric material are often wound onto elongated cylindrical cores to form a roll of material. These rolls of material are usually quite large and can weigh hundreds or thousands of pounds. Because the formation of these materials generally involves a continuous process, a full roll of material is usually switched out for an empty core while the process is still running or has been momentarily stopped. This requires that the material being fed to the full roll be cut and then quickly wound onto an empty core for continued winding of the material. The cores can be coated or partially coated with an adhesive to facilitate attaching the material to the core to begin the winding process. When winding is to begin on a fresh core, it can involve an operator manually positioning the material onto the core. Since the systems for feeding the material to the core for winding generally involve other rollers and the formation of nip points between rollers, manually placing the material on the core can be quite dangerous and has historically resulted in some operators being injured by having their hands and arms caught in the above-described nip points.

SUMMARY OF THE INVENTION

The present invention resides in one aspect in a winder assembly that includes a turret assembly having a first core and at least a second core mounted for rotation on the turret assembly. During operation, a web of sheet-type work material is wound around one of the first and second cores. When a desired amount of work material has been wound onto the core, the turret assembly is operable to index the other of the cores into a winding position. A lay-on roll assembly is mounted to a frame near to, or forming part of, the turret assembly and includes at least one roller coupled for rotation to the lay-on roll assembly. The lay-on roll assembly is movable between a retracted and an engaged position wherein the roller, one of the cores and/or the sheet-type work material wound onto the core cooperate to define a first nip there between.

An enveloper assembly is also provided and includes at least one pivot arm coupled to a frame. The pivot arm is moveable between a retracted position and an operating position. A first actuator is pivotally coupled to the frame as well as to the pivot arm. The first actuator is moveable between a retracted position and an extended position so that when the first actuator is in the extended position, the pivot arm is in the operating position. At least one pivot roll side plate is pivotally coupled to the pivot arm for movement between a retracted position and a working position, and a second actuator is coupled to the pivot arm and to the pivot roll side plate. The second actuator is movable between a retracted position and an extended position so that when the second actuator is in the extended position, the pivot roll side plate is in the working position. A nipping pivot roller is rotatably coupled to the pivot roll side plate. Cutting means are provided for cutting the web of sheet-type work material to separate the work material from one of the first and second cores in response to the core having a desired amount of work material rolled there around.

During operation, the web of sheet-type work material moves in a longitudinal direction and is threaded onto the lay-on roll assembly. The work material passes over the roller that forms part of the lay-on roll assembly. Accordingly, when the lay-on roll assembly is in the engaged position and the web of sheet-type work material is being wound onto the first core, the work material passes over the roller forming part of the lay-on roll assembly and between the nip formed by the work material winding onto the core and the roller.

In an embodiment of the present invention, an accumulator is provided upstream of the winder assembly. During operation, in order for the cutting means to cut the work material so that the cut edge of the work material is substantially perpendicular to a longitudinal direction defined by the work material, the movement of the work material in the area of the cutting means needs to momentarily stop. When this occurs, the work material upstream of the cutting means continues to be processed and to move. In order to prevent movement of the work material in the vicinity of the cutting means, the material collects in the accumulator. Once the cutting means has separated the work material from a full roll and winding of the work material begins on a new core, the material collected by the accumulator is wound onto the new core.

In an embodiment of the present invention, a plurality of guide rollers are coupled for rotation to the pivot roll side plate and are operable to engage the work material and hold the work material against the core when the pivot roll side plate is in the working position. In order to conform to an outer contour defined by the core, the plurality of guide rails can be pivotally coupled together to form a string of guide rails. Biasing means may also be provided for urging the nipping pivot roller against the work material core in response to the pivot roll side plate being in the working position.

The present invention also resides in a method for automatically changing a core in a winder assembly. During operation, and as described above, the web of sheet-type work material is moved in the longitudinal direction and winds onto the first core.

When a desired amount of work material has wound onto the first core, the turret assembly, in response to commands issued from the controller, indexes the first core to the roll removal position and the empty second core to the winding position. Prior to the indexing operation, the lay-on roll assembly responsive to commands issued from the controller, moves from the engaged to the retracted position. With the first core having the work material rolled thereon, and the lay-on roll in the retracted position, the web of sheet-type work material extends between the roller forming part of the lay-on roll assembly, and under the second core. The pivot arm forming part of the enveloper assembly is moved to the operating position so that the work material is positioned between the second core and the nipping pivot roller, the nipping pivot roller pressing the work material against the second core.

The cutting means is actuated to cut the web of sheet-type work material below the nipping pivot roller leaving a tail portion of the work material that ends in a cut web edge. The above-described second actuator then causes the pivot roll side plate, and thereby the nipping pivot roll, to rotatably move around the rotating second core, thereby feeding the cut web edge into the nip formed by the roller forming part of the lay-on roll assembly and the core. The web of sheet-type work material then wraps around the second core and begins winding there about.

DETAILED DESCRIPTION OF THE PREFERRED EMBODIMENTS

Figure 1:
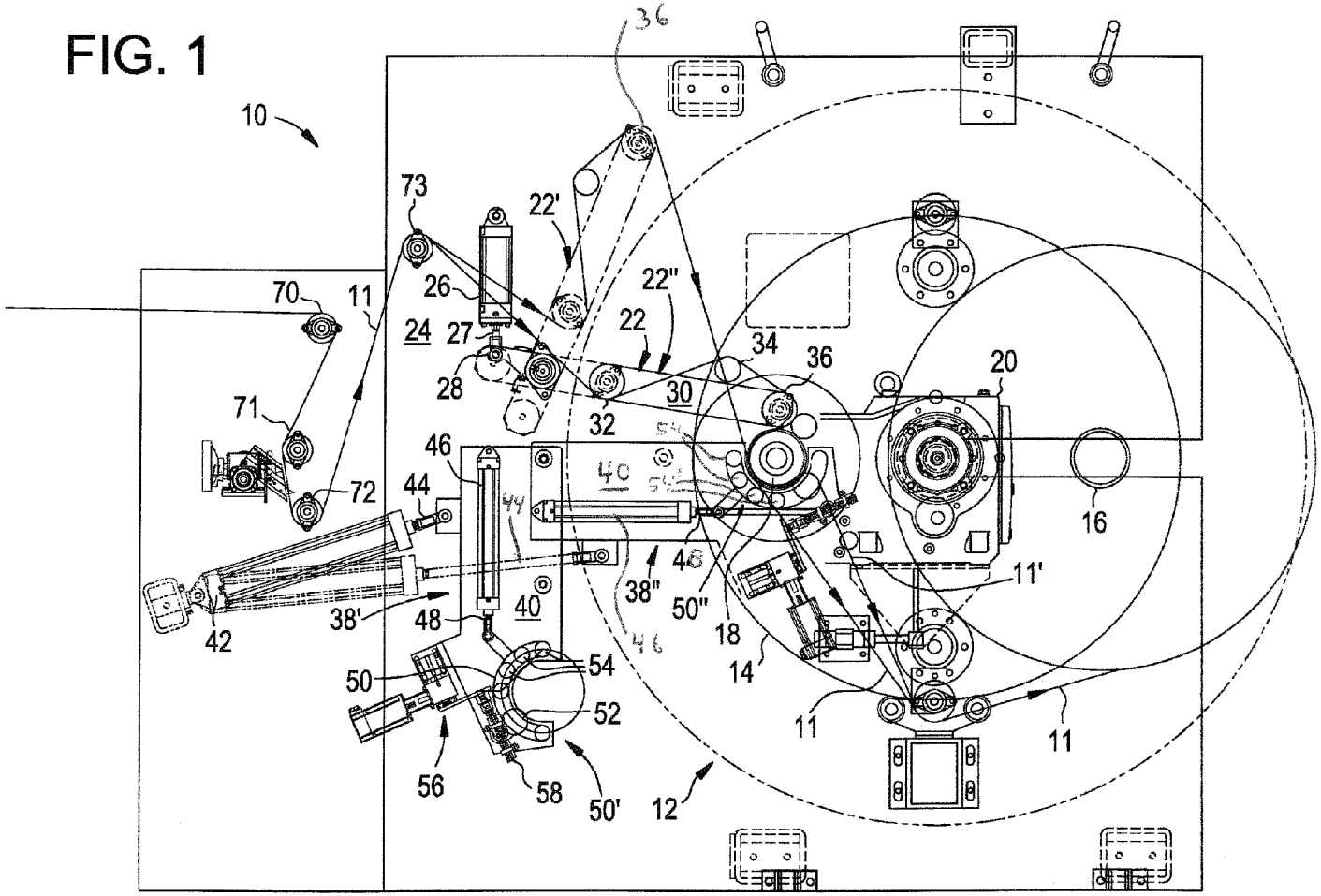
FIG. 1 schematically illustrates a winder assembly in accordance with the present invention.

As shown in FIGS. 1-6, a winder assembly generally designated by the reference number 10 is employed to facilitate the winding of a web of sheet-type work material 11 onto a core to form a roll of the work material. The winder assembly 10 includes a turret assembly generally designated by the reference number 12. The turret assembly 12 includes a first frame 14 and a second frame 14*a* (not shown) spaced apart from the first frame and coupled thereto by one or more spacer members (not shown). A first core 16 and a second core 18 extend between the first and the second frames, 14 and 14*a* respectively and are mounted for rotation relative thereto. As shown in the illustrated embodiment, the first and the second cores, 16 and 18 respectively, are substantially parallel to, and spaced apart from, one another. A gearbox 20 is coupled to one of the first and second frames, 14 and 14*a* respectively, and is actuated via a motor (not shown) in response to commands issued from a controller (not shown), to rotate the first and second frames, thereby indexing one of the first and second cores 16 and 18 into a winding position (explained in greater detail below), and the other of the first and second cores into a roll removal position (also explained in greater detail below).

As shown in FIGS. 1-6, the winder assembly 12 also includes a lay-on roll assembly generally designated by the reference number 22. The lay on roll assembly 22 is pivotally mounted to the frame 24 for rotational movement relative thereto. A pneumatic cylinder 26 is also coupled at one end to a frame and includes a plunger 27 moveable between a retracted and an extended position. An end of the plunger 27 is pivotally mounted to an end 28 of a pivot arm 23 forming part of the lay-on roll assembly 22 so that movement of the piston between the retracted and the extended position causes the lay-on roll assembly to move between a retracted position 22' (best seen in FIGS. 1 and 2) and an engaged position 22" (also best seen in FIGS. 1 and 2). While a pneumatic cylinder has been shown and described, the present invention is not limited in this regard as other types of actuators such as, but not limited to, hydraulic cylinders, stepper motors, and lead screws may be substituted without departing from the broader aspects of the present invention.

The lay-on roll assembly 22 includes a pair of pivot arms 30 (only one shown) having three rollers 32, 34 and 36 that extend between the arms and are rotatably coupled thereto. Each of the three rollers 32, 34 and 36 can be covered with a polymeric or elastomeric material. As will be explained in greater detail below, during operation, the web of sheet-type work material 11 extends between the roller 32, 34 and 36 in woven fashion such that the work material passes under the first roller 32, over the second roller 34, and under the third roller 36. Therefore, when the lay-on roll assembly 22 is in the engaged position 22", the roller 36 is in rolling engagement with the work material 11 being wound onto the core. The work material is fed between a nip defined by the roller 36 and the work material already wound onto the core. While the lay-on roll assembly 22 has been shown and described as being pivotally mounted to the frame 24, the present invention is not limited in this regard as the lay-on roll assembly can be mounted to other items or the lay-on roll assembly can be mounted onto its own stand without departing from the broader aspects of the present invention.

The winder assembly 10 further includes an enveloper assembly generally designated by the reference number 38. In the illustrated embodiment, the enveloper assembly 38 includes a pair of pivot arms 40 (only one shown) spaced apart from one another and coupled to the frame 24. The pivot arms are moveable between a retracted position 38' and an operating position 38". The pair of pivot arms 40 is spaced apart one from the other by an amount at least equal to the length of the core 16 and 18. A first actuator 42, shown in the illustrated embodiment as a pneumatic cylinder, is pivotally coupled to the frame 24 at one end and includes a plunger 44 moveable between a retracted position and an extended position. Accordingly, when the first actuator 42 is in the extended position, the pivot arm 40 is in the operating position 38". While the enveloper assembly 38 has been shown as including only one first actuator 42 coupled to the frame 24 and to one of the pair of pivot arms 40, the present invention is not limited in this regard as a second, first actuator 42 can be coupled to the frame and the other of the pair of pivot arms. Moreover, while the first actuator has been shown and described as being a pneumatic cylinder, the present invention is not limited in this regard as other types of actuators such as, but not limited to, hydraulic cylinders, stepper motors or lead screws, may also be employed without departing from the broader aspects of the present invention.

Figure 4:
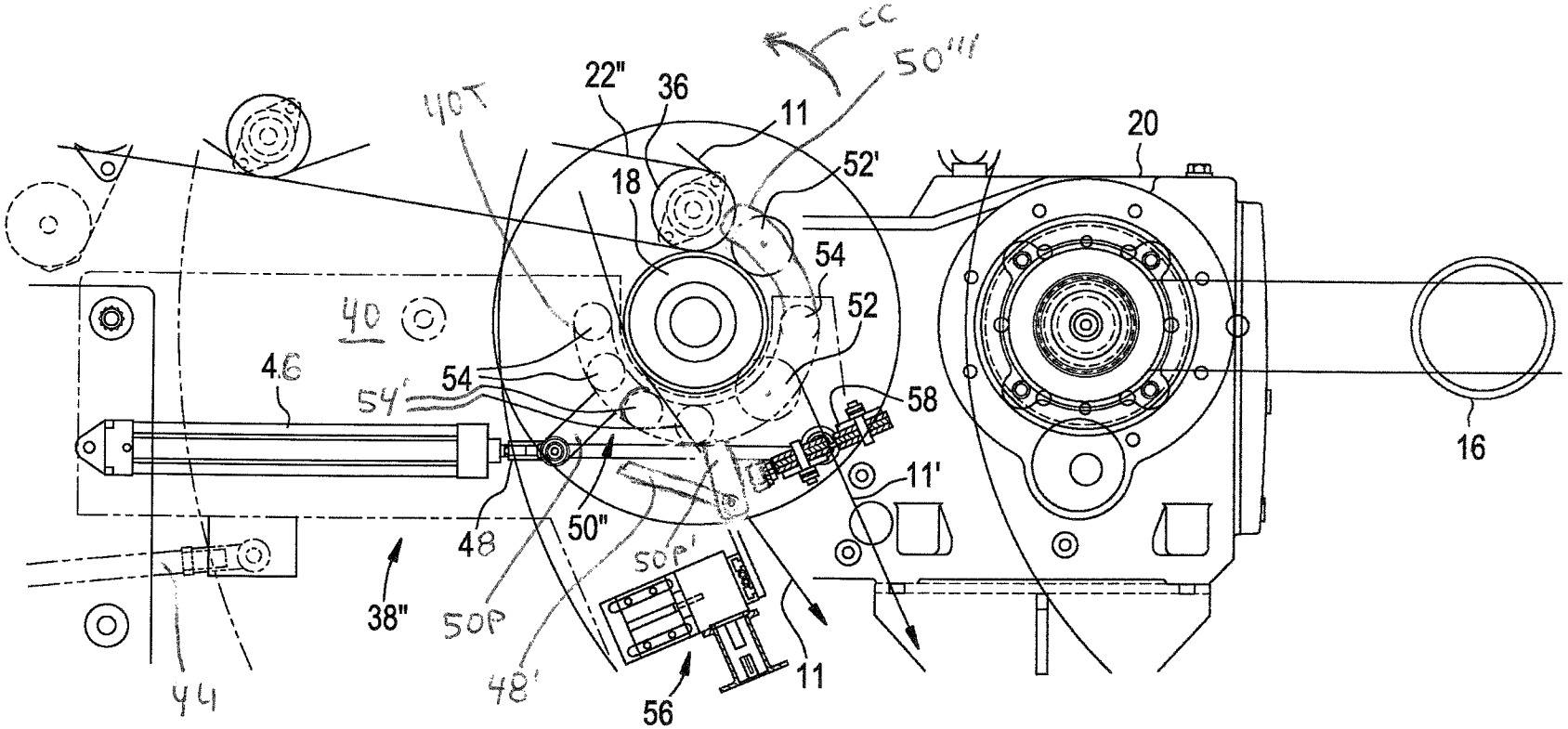
FIG. 4 is a partial enlarged view of FIG. 1 showing the enveloper assembly of FIG. 3 showing a pivot arm in an operating position and a pivot roll side plate in a working position.

The enveloper assembly 38 also includes a second actuator 46, shown in the illustrated embodiment as a pneumatic cylinder. The second actuator 46 is pivotally coupled at one end to the pivot arm 40 and includes a plunger 48 moveable between a retracted and a first and second extended position. The plunger 48 is pivotally coupled to a pivot roll side plate 50 (e.g. a link or pivot arm 50P extending therefrom) which in turn is coupled for rotation to the pivot arm 40 by a plurality of guide rollers 54 (e.g. two) that roll in an arcuate track 40T formed in the pivot arm 40 . During operation, when the plunger 48, in response to commands issued from the controller, moves from the retracted position toward the first extended position, the plunger 48' extends as shown in FIG. 4, the pivot roll side plate 50 moves from a retracted position 50' to a working position 50". When the plunger 48 moves from the first extended position to the second extended position, 48' (see 52' in FIG. 4), the pivot roll side plate 50 moves the link arm 50P and the nipping roller 52 from the working position to a web feeding position 50'". While a single pivot roll side plate 50 has been shown and described, the present invention is not limited in this regard as at least a second pivot roll side plate 50 can be coupled for rotation to the other of the pair of pivot arms. In addition, while the enveloper assembly 38 has been shown as including only one second actuator 46 coupled to one of the pair of pivot arms 40, the present invention is not limited in this regard as a second, second actuator 46 can be coupled to the other of the pair of pivot arms. Moreover while the second actuator has been shown and described as being a pneumatic cylinder, the present invention is not limited in this regard as other types of actuators such as, but not limited to, hydraulic cylinders, stepper motors or lead screws, may also be employed without departing from the broader aspects of the present invention.

A nipping pivot roller 52 is coupled for rotation to, and extends between, the pivot roll side plates 50. The nipping pivot roller 52 can be covered with a polymeric or elastomeric material to increase friction. During operation, when the pivot arms 40 are in the operating position 38" and the pivot roll side plates 50 are in the working position 50", the nipping pivot roller 52 is operable, as will be explained in greater detail below, to engage the sheet-type work material 11 and press it against one of the cores 16 and 18 positioned in the winding position. When the pivot roll side plates 50 and thereby the nipping pivot roller 52 moves to the web feed position 50'" wherein (as explained in detail below) a cut web edge can be fed between the nip formed between the roller forming part of the lay-on roll assembly 22, and the core thereby causing the work material 11' to wind around the core.

Figure 5D:
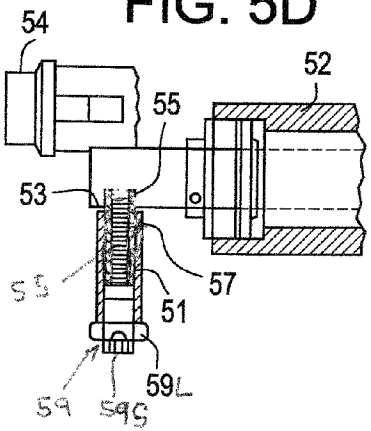
FIGS. 5A-E schematically illustrates portions of the enveloper assembly of FIG. 3.
Figure 5C:
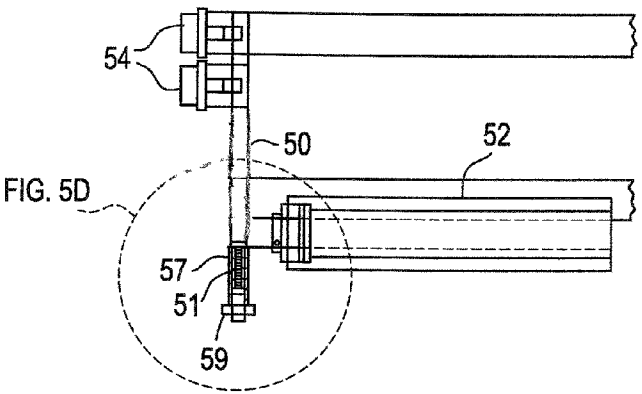
Figure 5A:
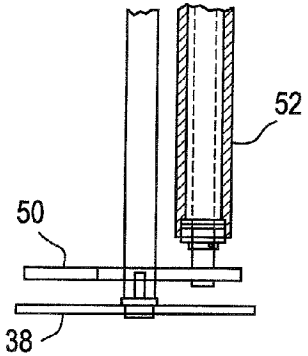
Figure 5B:
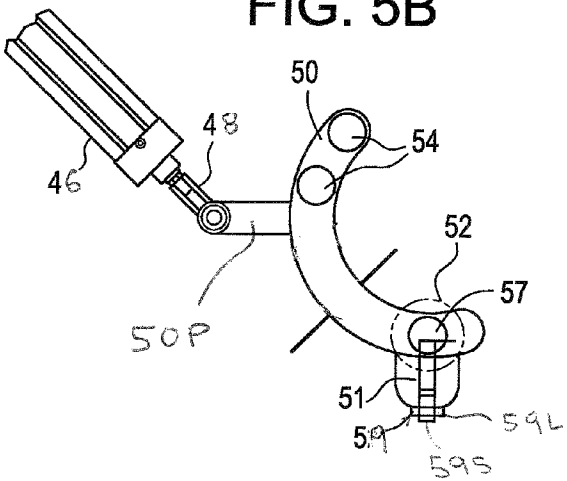
Figure 5E:
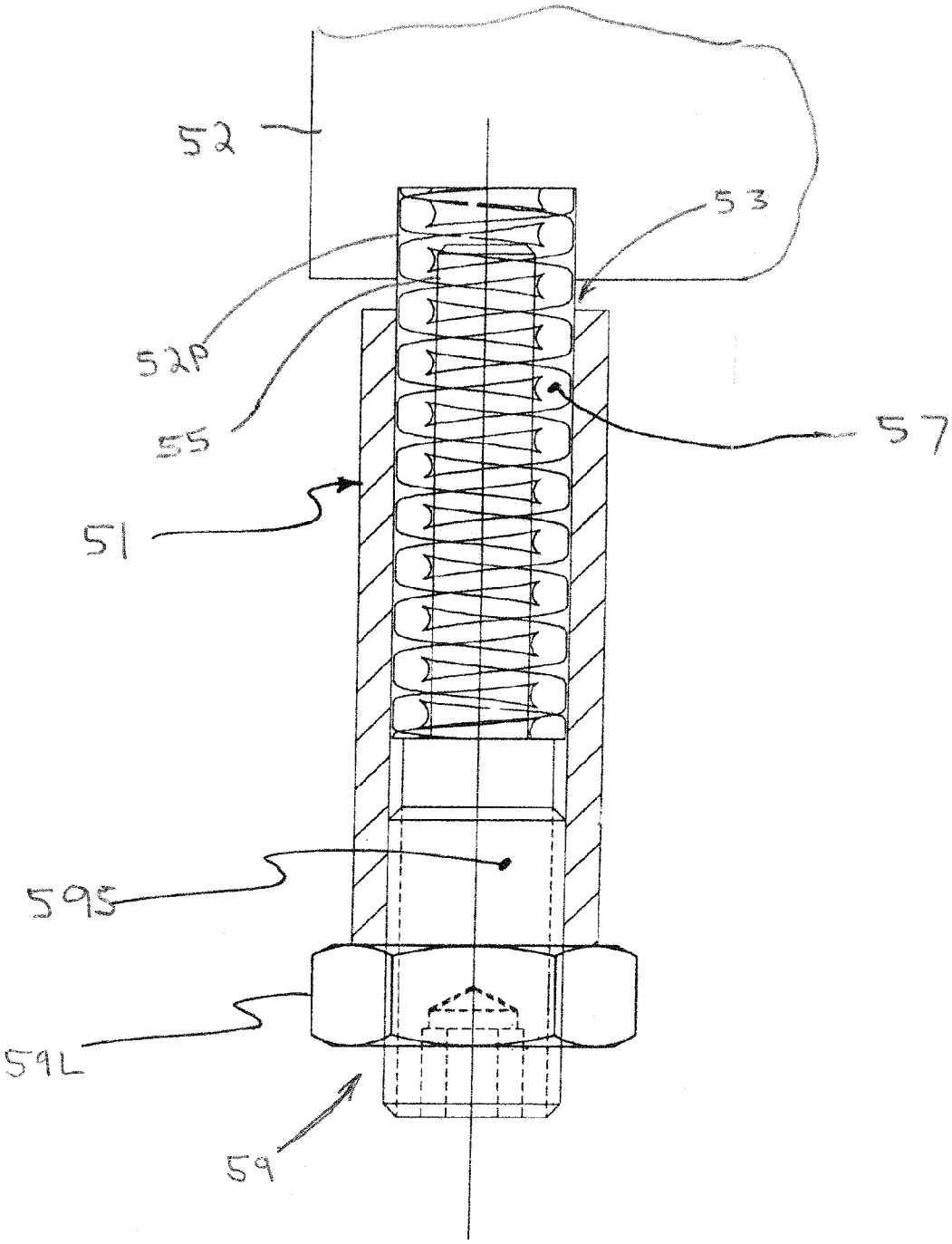

Referring to FIGS. 5A-E, the enveloper assembly 38 includes a housing 51 mounted on the roll plate 50, the housing defining a bore 53 extending there through. A sleeve 55 is slidably positioned in the bore 53 and a spring 57 abuts a portion of the sleeve. As best shown in FIGS. 5B, C. D and E, a biasing member 59 (e.g., set screw 59S and locking nut 59L) is threadably engaged in an end of the housing 51. Upon rotation of the biasing member 59 in a first direction, the biasing member engages and compresses the spring 57, thereby urging the spring 57 against a portion of the nipping pivot roller 52 (e.g., a shaft supporting the nipping roller) and exerting pressure thereon. Rotation of the biasing member 59 in a second direction, opposite the first direction, causes the pressure exerted by the spring 57 on the sleeve 55 to be reduced. During operation, the pressure exerted by the sleeve 55 on the nipping pivot roller 52 causes a concomitant increase or decrease in an amount of pressure the nipping pivot roller 52 exerts on the web of sheet-type work material 11 when the work material is sandwiched between the nipping pivot roller 52 and one of the first and second cores, 16 and 18 respectively While the spring 57 is described as engaging a portion of the nipping roller 52, the present invention is not limited in this regard, as the sleeve 55 may be invented in the bore 53 and compression of the spring 57 causes the sleeve 55 to engage a portion of the nipping roller 52.

The plurality of guide rollers 54 are coupled to the pivot roll side plates 50 and roll in the arcuate track 40T to guide the pivot roll side plastes 50 in an arc around the core 16 and to thereby move the nipping pivot roller 52 around the core 16 in the counter clockwise direction, for example, as shown by the arrow CC in FIG. 4 to 52'.The guide rollers 54 are flexibly linked together to form a string so that when the pivot roll side plates 50 are in the working position 50", nipping pivot roller 52, 52' rotatably engages the core 16 or 18 with the work material 11' located there between, thereby holding the work material against the core. The guide rollers 54 progressively move in an arcuate manner along with the pivot roll side plate 50 as indicated by guide rollers 54' , shown in FIGS. 1, 3 and 4. A cutting assembly, generally designated by the reference number 56, is coupled to and extends between the pair of pivot arms 40. The cutting assembly 56 includes a cutter 58 that can be in the form of a cutting blade or a cutting wheel. The cutter 58 is movable transversely across the web of sheet-type work material 11 to cut and separate the work material from the core 16 or 18 about which the work material is being wound once a desired amount of work material has been wound onto the core. Once the cutter 58 cuts the work material, a tail of work material ending in a cut work material edge hangs below the nipping pivot roller 52.

Figure 6:
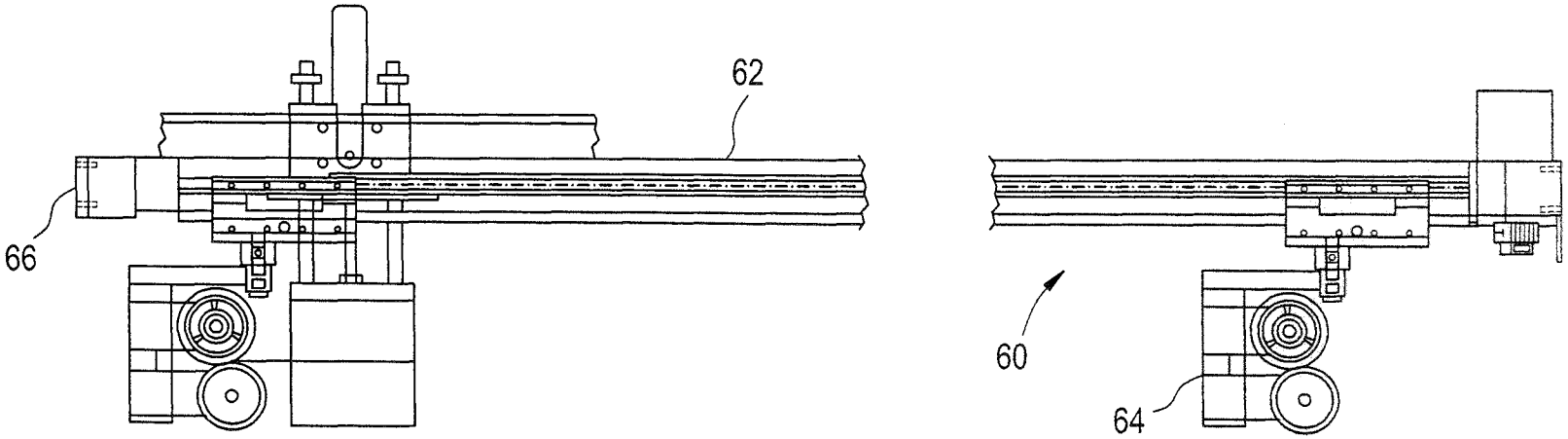
FIG. 6 schematically illustrates the cutting assembly that forms part of the enveloper assembly of FIG. 3.

Referring to FIG. 6, the cutting assembly 56 includes a traverse assembly generally designated by the reference number 60. The traverse assembly includes a track 62 that extends transversely across the web of sheet-type work material 11. A cutting head 64 having the cutter 58 mounted thereon is coupled to the track 62 for rectilinear movement there along. An actuator 66 is coupled to the cutting head 64 and the track 62 and is operable to cause the cutting head to move along the track.

Figure 2:
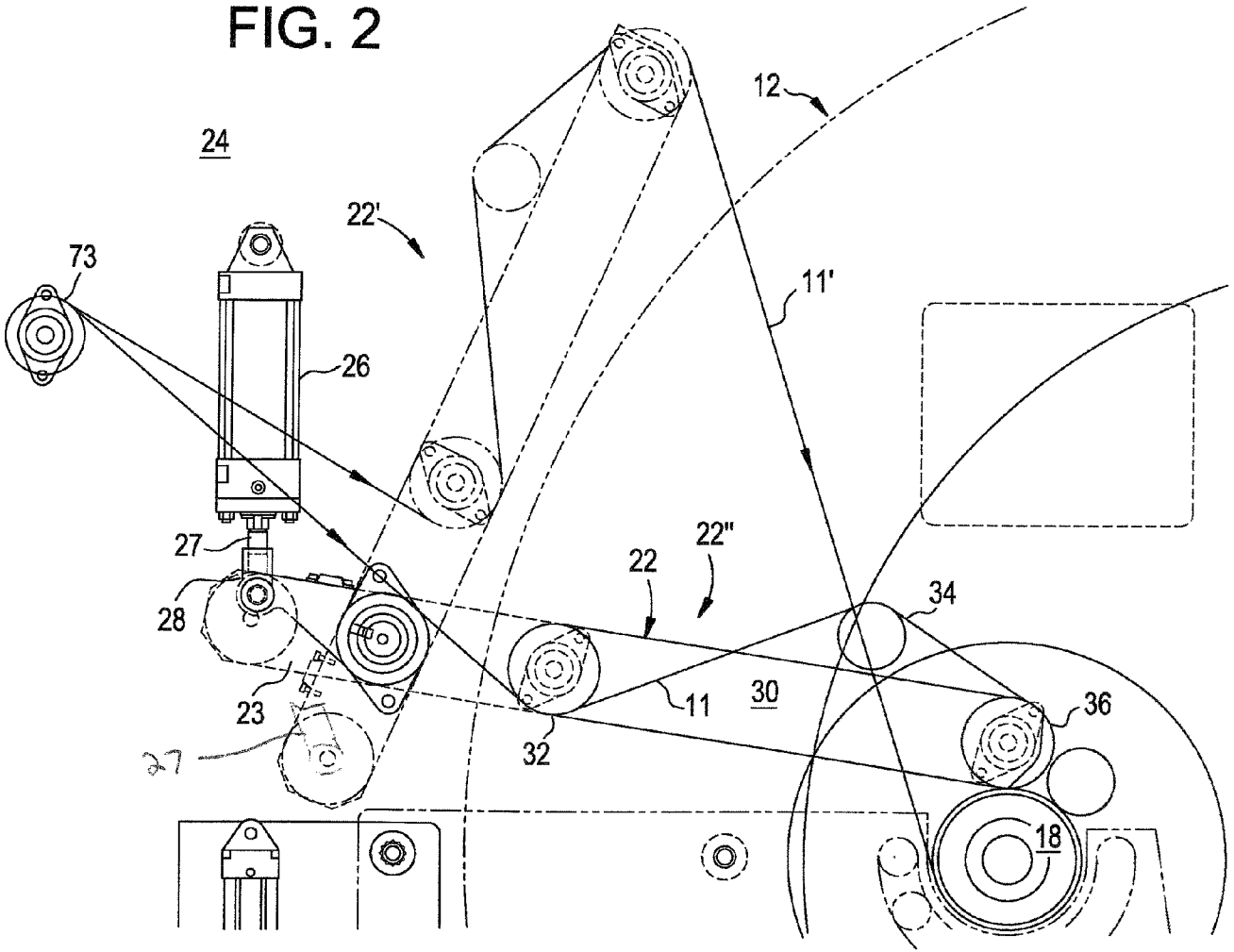
FIG. 2 is a partial enlarged view of FIG. 1 showing a lay-on roll assembly in a retracted position and in an engaged position.
Figure 3:
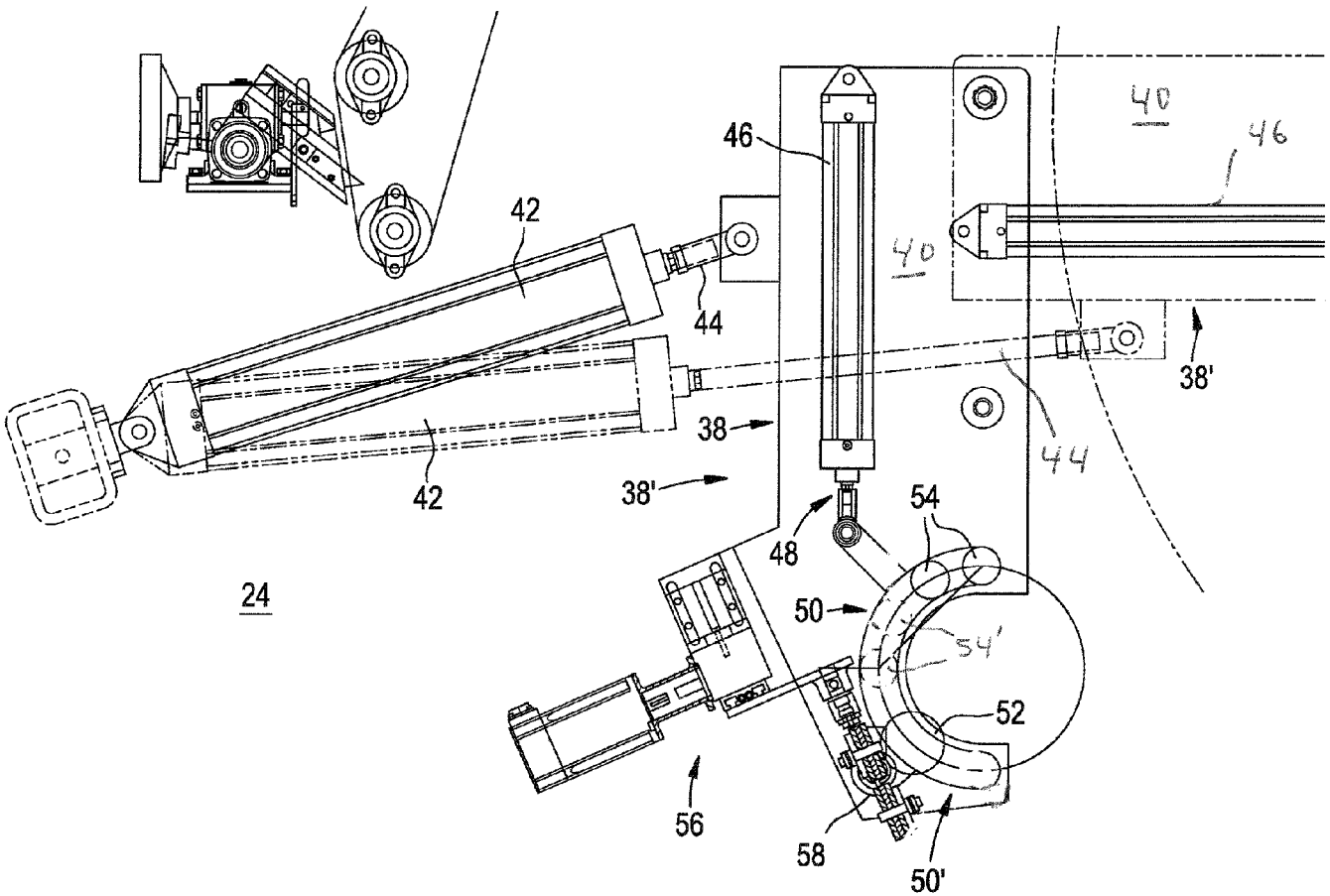
FIG. 3 is a partial enlarged view of FIG. 1 showing an enveloper assembly in a retracted position.

Referring to FIGS. 1 and 2, during operation, the sheet-type work material 11 is wound around one of the first and second cores, 16 and 18 respectively, to form a roll of work material. The sheet-type work material 11, prior to reaching the core, is created or processed upstream of the winder assembly 10. In the illustrated embodiment, the work material 11 is thread over rollers 70, 71, 72 and 73. The work material 11 then moves relative to, and is engaged by, the rollers 32, 34 and 36 that form part of the lay-on roll assembly 22. While the work material 11 is being wound onto the core, 16 or 18, the lay-on roll assembly 22 is in the engaged position wherein the roller 36 rollingly engages the work material being wound onto the core, forming a nip there between. As will be explained in greater detail below, the above-described nip is initially formed between the roller 36 and the core 16 or 18 upon which the work material is being wound.

Once a desired amount of work material 11 has been wound onto a core, the lay-on roll assembly 22 moves from the engaged position 22" to the retracted position 22'. The turret assembly 12 rotatingly indexes an empty core into the winding position for winding the web of sheet-type work material 11 thereon. Since the work material 11 is still winding onto the full core (element 16 in FIG. 1), the enveloper assembly 38 moves from the retracted position 38' (best seen in FIG. 3) to the operating position 38" (best seen in FIG. 4). Similarly, the pivot roll side plates 50 move from the retracted position 50' (best seen in FIG. 3) to the working position 50" (best seen in FIG. 4). Movement of the pivot roll side plates 50 to the working position 50" causes the nipping pivot roller 52 to rollingly engage the work material 11, pressing the nipping pivot roller 52 against the core 18. This alters the path of the work material to that indicated by the reference number 11' (FIGS. 1 and 4). The cutting assembly 56 is then actuated, causing the cutter 58 to move transversely across the web of sheet-type work material 11', thereby cutting the work material from the core 16 upon which it was being wound.

Prior to the work material 11' being cut in the above-described manner, the work material 11', which was moving longitudinally as it was being wound onto the core 16, can be stopped. In order to maintain continuous upstream processing of the web of sheet-type work material 11 while its longitudinal movement is stopped relative to the core, an accumulator, known to those skilled in the pertinent art to which the present invention pertains, may be employed.

Once the work material 11' has been cut, a tail portion of the work material extends between the nipping pivot roller 52 and the cutter 58 and defines a cut web edge. The second actuator 46 is further energized and thereby causes the pivot roll side plate 50, and thereby the nipping pivot roller 52, to move around the core 18 to the web feeding position, causing the above-described tail portion to likewise move around the core. Simultaneous with, or prior to, the further movement of the nipping pivot roll 52 to the position indicated at 52', the lay-on roll assembly is moved to the engaged position 22" so that the roller 36 is in rolling engagement with the core 18, thereby defining the above-described nip between the core and the roller. The cut web edge is fed into the nip by the movement of the nipping pivot roller 52 so that the movement of the work material and the rotation of the core cause the work material to wrap around the core and begin winding thereon.

Although the invention has been described with reference to particular embodiments thereof, it will be understood by one of ordinary skill in the art, upon a reading and understanding of the foregoing disclosure, that numerous variations and alterations to the disclosed embodiments will fall within the spirit and scope of this invention and of the appended claims.

What is claimed is:

1. A winder assembly comprising:

a turret assembly rotatably mounted to a frame and a first core and at least one second core mounted for rotation on the turret assembly so that during operation, a web of sheet-type work material can be wound around the first core and the at least one second core, the turret assembly being operable to selectively index the first core and the at least one second core into a winding position and a roll removal position;

a lay-on roll assembly pivotally mounted to the frame, the lay-on roll assembly including:

at least one lay-on roller coupled for rotation to the lay-on roll assembly, the lay-on roll assembly being movable between a first retracted position and a first extended position wherein in the first extended position, the web of sheet-type work material is engaged in a nip formed between the at least one lay-on roller and one of the first core and the at least one second core;

an enveloper assembly including:

at least one first pivot arm pivotally coupled to the frame and moveable between a second retracted position and second extended position;

at least one second pivot arm pivotally coupled to the at least one first pivot arm;

at least one pivot roll side plate pivotally coupled to the at least one first pivot arm and the at least one second pivot arm, the at least one pivot side roll plate being configured for curvilinear movement from a working position, circumferentially around one of the first core and the at least one second core to a web feeding position; and a nipping pivot roller pivotally coupled to the pivot roll side plate;

cutting means for cutting the web of sheet-type work material to separate the work material from one of the first core and the at least one second core in response a desired amount of work material rolled there around; and wherein during operation, the turret assembly indexes the first core into the roll removal position and the at least one second core into the winding position, the pivot roll side plate is moved to the working position whereby the nipping pivot roller is operable to press the sheet-type work material against the second core, the cutting means separates the work material from the first core, the pivot roll side plate is moved to the web feeding position whereby the nipping pivot roller is operable to cause the sheet-type work material to be fed into the nip and begin winding around the second core;

further comprising biasing means for urging the nipping pivot roller against the work material and the first core in response to the pivot roll side plate being in the working position, the web feeding position or therebetween;

wherein the biasing means includes a housing coupled to the pivot roll side plate, the housing defining a bore extending at least part way there through, a sleeve slidingly positioned within the bore; a biasing member threadably engaged in an end of the housing, a spring positioned in the housing and interposed between the biasing member and the sleeve, the sleeve being engagable with the nipping pivot roller and wherein rotation of the biasing member in a first direction causes the spring to be urged against the sleeve which is thereby urged against the nipping pivot roller.

2. The winder assembly as defined by claim 1 further comprising an accumulator positioned upstream of the turret assembly and operable to, during a cutting operation, collect the sheet-type work material being fed toward one of the first core and the at least one second core, thereby allowing the one of the first core and the at least one second core to stop rotating and the cutting means to cut the work material substantially perpendicular to a feed direction thereof.

3. A method for changing cores on a winder assembly, comprising:

providing a turret assembly including a first core and at least one second core mounted for rotation on the turret assembly, the first core having a web of sheet-type work material winding there around;

providing a lay-on roll assembly pivotally mounted to a frame, at least one lay-on roller mounted to the lay-on roll assembly;

providing an enveloper assembly including at least one pivot arm coupled to the frame, the enveloper assembly further including at least one second pivot arm pivotally coupled to the at least one first pivot arm, at least one pivot roll side plate pivotally coupled to the at least one first pivot arm and the at least one second pivot arm and a nipping pivot roller rotatably coupled to the pivot roll side plate;

the method further includes, in the following order:

a first step of moving the lay-on roll assembly to a retracted position wherein the at least one lay-on roller is tilted off of and away from the work material wound onto the first core or the at least one second core;

a second step of causing the turret assembly to index the first core onto a roll removal position and one of the at least one second core into a winding position;

a third step of moving the enveloper assembly to an operating position and moving the at least one pivot roll side plate to a working position so that the nipping pivot roller rolling engages the one of the at least one second core;

a fourth step of cutting the web of sheet-type work material to separate the work material from the work material wound onto the first core, thereby creating a work material tail portion;

a fifth step of moving the pivot roll side plate circumferentially around the one of the at least one second core to a web feeding position causing the pivot roller to engage the work material tail portion; and simultaneously with the fifth step, or between the fourth step and the fifth step, moving the lay-on roll assembly to an engaged position wherein the work material tail is fed into a nip formed between the one of the at least one second core and the at least one lay-on roller; and further providing biasing means including a housing coupled to the pivot roll side plate, the housing defining a bore extending at least part way there through, a sleeve slidingly positioned within the bore; a biasing member threadably engaged in an end of the housing, a spring positioned in the housing and interposed between the biasing member and the sleeve;

rotating the biasing member in a first direction urging the spring against the sleeve thereby urging the sleeve against a portion of the nipping roller, and urging the nipping pivot roller against the work material and the first core in response to the pivot roll side plate being in the working position.

4. A winder assembly comprising:

a turret assembly rotatably mounted to a frame and a first core and at least one second core mounted for rotation on the turret assembly so that during operation, a web of sheet-type work material can be wound around the first core and the at least one second core, the turret assembly being operable to selectively index the first core and the at least one second core into a winding position and a roll removal position;

a lay-on roll assembly pivotally mounted to the frame, the lay-on roll assembly including:

at least one lay-on roller coupled for rotation to the lay-on roll assembly, the lay-on roll assembly being movable between a first retracted position and a first extended position wherein in the first extended position, the web of sheet-type work material is engaged in a nip formed between the at least one lay-on roller and one of the first core and the at least one second core;

an enveloper assembly including:

at least one first pivot arm pivotally coupled to the frame and moveable between a second retracted position and second extended position;

at least one second pivot arm pivotally coupled to the at least one first pivot arm;

at least one pivot roll side plate pivotally coupled to the at least one first pivot arm and the at least one second pivot arm, the at least one pivot side roll plate being configured for curvilinear movement from a working position, circumferentially around one of the first core and the at least one second core to a web feeding position; and a nipping pivot roller pivotally coupled to the pivot roll side plate;

cutting means for cutting the web of sheet-type work material to separate the work material from one of the first core and the at least one second core in response a desired amount of work material rolled there around; and wherein during operation, the turret assembly indexes the first core into the roll removal position and the at least one second core into the winding position the pivot roll side plate is moved to the working position whereby the nipping pivot roller is operable to press the sheet-type work material against the second core, the cutting means separates the work material from the first core, the pivot roll side plate is moved to the web feeding position whereby the nipping pivot roller is operable to cause the sheet-type work material to be fed into the nip and begin winding around the second core;

further comprising biasing means for urging the nipping pivot roller against the work material and the first core in response to the pivot roll side plate being in the working position, the web feeding position or therebetween;

wherein the biasing means includes a housing coupled to the pivot roll side plate, the housing defining a bore extending at least part way there through, a sleeve slidingly positioned within the bore; a biasing member threadably engaged in an end of the housing, a spring positioned in the housing and interposed between the biasing member and the sleeve, the spring being engagable with a portion of the nipping pivot roller and wherein rotation of the biasing member in a first direction causes the spring to be urged against the nipping pivot roller.

5. A method for changing cores on a winder assembly, comprising:

providing a turret assembly including a first core and at least one second core mounted for rotation on the turret assembly, the first core having a web of sheet-type work material winding there around;

providing a lay-on roll assembly pivotally mounted to a frame, at least one lay-on roller mounted to the lay-on roll assembly;

providing an enveloper assembly including at least one pivot arm coupled to the frame, the enveloper assembly further including at least one second pivot arm pivotally coupled to the at least one first pivot arm, at least one pivot roll side plate pivotally coupled to the at least one first pivot arm and the at least one second pivot arm and a nipping pivot roller rotatably coupled to the pivot roll side plate;

the method further includes, in the following order:

a first step of moving the lay-on roll assembly to a retracted position wherein the at least one lay-on roller is tilted off of and away from the work material wound onto the first core or the at least one second core;

a second step of causing the turret assembly to index the first core onto a roll removal position and one of the at least one second core into a winding position;

a third step of moving the enveloper assembly to an operating position and moving the at least one pivot roll side plate to a working position so that the nipping pivot roller rolling engages the one of the at least one second core;

a fourth step of cutting the web of sheet-type work material to separate the work material from the work material wound onto the first core, thereby creating a work material tail portion;

a fifth step of moving the pivot roll side plate circumferentially around the one of the at least one second core to a web feeding position causing the pivot roller to engage the work material tail portion; and simultaneously with the fifth step, or between the fourth step and the fifth step, moving the lay-on roll assembly to an engaged position wherein the work material tail is fed into a nip formed between the one of the at least one second core and the at least one lay-on roller; and further providing biasing means including a housing coupled to the pivot roll side plate, the housing defining a bore extending at least part way there through, a sleeve slidingly positioned within the bore; a biasing member threadably engaged in an end of the housing, a spring positioned in the housing and interposed between the biasing member and the sleeve;

rotating the biasing member in a first direction urging the spring against a portion of the nipping roller, and urging the nipping pivot roller against the work material and the first core in response to the pivot roll side plate being in the working position.

* * * * *